US005344143A

United States Patent [19]

Yule

[11] Patent Number: 5,344,143

[45] Date of Patent: Sep. 6, 1994

[54] MARBLE RUN GAME

[76] Inventor: Lance Yule, 218 Main St., Silver Lake, N.H. 03875

[21] Appl. No.: 93,803

[22] Filed: Jul. 19, 1993

[51] Int. Cl.[5] ..... A63F 7/00

[52] U.S. Cl. ..... 273/118 R; 446/118; 446/120; 446/127; 446/128

[58] Field of Search ..... 273/108, 118 R, 156, 273/160; 446/118, 128, 120, 127, 168, 170

[56] References Cited

U.S. PATENT DOCUMENTS

| | | | |
|---|---|---|---|
| D. 290,026 | 5/1987 | Wichman . | |
| D. 290,028 | 5/1987 | Wichman . | |
| D. 290,143 | 6/1987 | Wichman . | |
| D. 290,145 | 6/1987 | Wichman . | |
| D. 293,696 | 1/1988 | Wichman . | |
| D. 294,044 | 2/1988 | Wichman . | |
| D. 294,959 | 3/1988 | Wichman . | |
| D. 305,042 | 12/1989 | Klitsner . | |
| D. 305,043 | 12/1989 | Klitsner . | |
| D. 305,044 | 12/1989 | Klitsner . | |
| D. 305,045 | 12/1989 | Klitsner . | |
| D. 305,046 | 12/1989 | Klitsner . | |
| D. 305,047 | 12/1989 | Klitsner . | |
| D. 305,345 | 1/1990 | Klitsner . | |
| D. 305,443 | 1/1990 | Klitsner . | |
| 2,838,870 | 6/1958 | Morse . | |
| 3,558,138 | 1/1971 | Lemelson | 446/127 X |
| 3,946,516 | 3/1976 | Wirth | 446/128 X |
| 4,171,090 | 10/1979 | Eisenberg | 446/168 X |
| 4,553,749 | 11/1985 | Bender et al. | 446/168 X |
| 4,713,038 | 12/1987 | Wichman et al. . | |
| 4,874,342 | 10/1989 | Klitsner . | |
| 4,932,917 | 6/1990 | Klitsner . | |
| 4,953,863 | 9/1990 | Ziedler et al. | 273/118 R X |
| 5,007,876 | 4/1991 | Klitsner . | |
| 5,056,789 | 10/1991 | Talbot . | |
| 5,139,259 | 8/1992 | Yeakley . | |

FOREIGN PATENT DOCUMENTS

| | | | |
|---|---|---|---|
| 47513 | 8/1920 | Sweden | 446/170 |

*Primary Examiner*—Vincent Millin
*Assistant Examiner*—Raleigh W. Chiu
*Attorney, Agent, or Firm*—Fish & Richardson

[57] ABSTRACT

A marble run game consists of a set of block elements constructed and arranged for assembly and disassembly by a user to create an extended, generally horizontal path for travel of a marble. Each block element has a top surface and one or more side surfaces, the top surface and at least one side surface of the block element together defining at least one groove for generally horizontal travel of a marble along the top surface and through a plane of the side surface.

11 Claims, 17 Drawing Sheets

MARBLE RUN GAME

BACKGROUND OF THE INVENTION

The invention relates to modular marble games.

It has been known to provide modular marble race games consisting of a plurality of elements that can be assembled by the user to create a marble race path. A well known, highly vertical version of this type of game is distributed by Discovery Toys, Inc. (Martinez, Calif.) and includes a wide variety of elements that may be assembled and disassembled by the user to erect a vast variety of marble race path-defining structures with self-contained support, the elements being designed with the expressed purpose of prolonging the period of time required for a marble to descend through the structure. Patents directed to the Discovery Toys race game include Wichman et al. U.S. Pat. Nos. 4,713,038; Klitsner 4,874,342; 4,932,917 and 5,007,876; Wichman U.S. Pat. Des. Nos. 290,026; 290,028; 290,143; 290,145; 293,696; 294,044 and 294,959; and Klitsner 305,042; 305,043; 305,044; 305,045; 305,046; 305,047; 305,345 and 305,443.

Earlier patents by others describing marble game structures with elements assembled by the user include Wirth U.S. Pat. Nos. 3,946,516 and Morse 2,838,870.

Other marble race games are provided with a fixed race path, e.g. as described by Talbot U.S. Pat. No. 5,056,789.

SUMMARY OF THE INVENTION

According to the invention, a marble run game comprises a set of block elements constructed and arranged for assembly and disassembly by a user to create an extended, generally horizontal path for travel of a marble, each block element having a top surface and one or more side surfaces, the top surface and at least one side surface of the block element together defining at least one groove for generally horizontal travel of a marble along the top surface and through a plane of the side surface.

Preferred embodiments of the invention may include one or more of the following additional features. Each block element comprises means for securement with an adjacent block element. For example, the means for securement may comprise a tongue extending from a surface of a first block element and a cooperating groove defined by an opposed surface of an adjacent block element, or the means for securement may comprise a hook member extending from a first block element and a cooperating slot defined by an adjacent block element, preferable, the hook member comprises a lip, and the slot defined by the adjacent block element comprises a cooperating groove. Each block element has a base surface opposite the top surface, and the base surface defines a plurality of apertures sized and arranged for registration with pegs of a peg block construction toy. The set of block elements comprises at least a first block element that, in use, defines a groove that is substantially horizontal and at least a second block element that, in use, defines a groove that is substantially sloped from the horizontal, the first block element and the second block element together defining the path for travel of a marble. At least one block element of the set of block elements defines an opening in connection with the groove and extending from the top surface, through the block element, the opening sized for passage of a marble along the groove and through the aperture. The top surface and a side surface of the block element together define a first groove for travel of a marble along the top surface and through a plane of the side surface; and the top surface and a side surface of the block element together define a second groove for travel of a marble along the top surface and through a plane of the side surface, preferably, the first groove and the second groove intersect upon the top surface. The set of block elements include a power block element comprising a source of electrical power, e.g. a solar panel disposed upon a surface of the power block element, and means for conducting electrical power to adjacent block elements.

Objectives of the invention include to provide a marble run game that is highly horizontal, and consists of multiple elements that can be joined together, on any type of base support, to create an entertaining path for a marble on the run.

These and other features and advantages of the invention will become apparent from the following description of a presently preferred embodiment, and from the claims.

BRIEF DESCRIPTION OF THE DRAWINGS

FIG. 1 is a side perspective view of one embodiment of a marble run game of the invention; while

FIGS. 16 and 17 are end perspective views of another embodiment of a block element of a marble run game of the invention, with cooperating hook and slot securement structure, while

FIG. 21 shows a washer board ramp;

FIGS. 52 and 53 show wire elements, while

DESCRIPTION OF THE PREFERRED EMBODIMENTS

Figure 1:
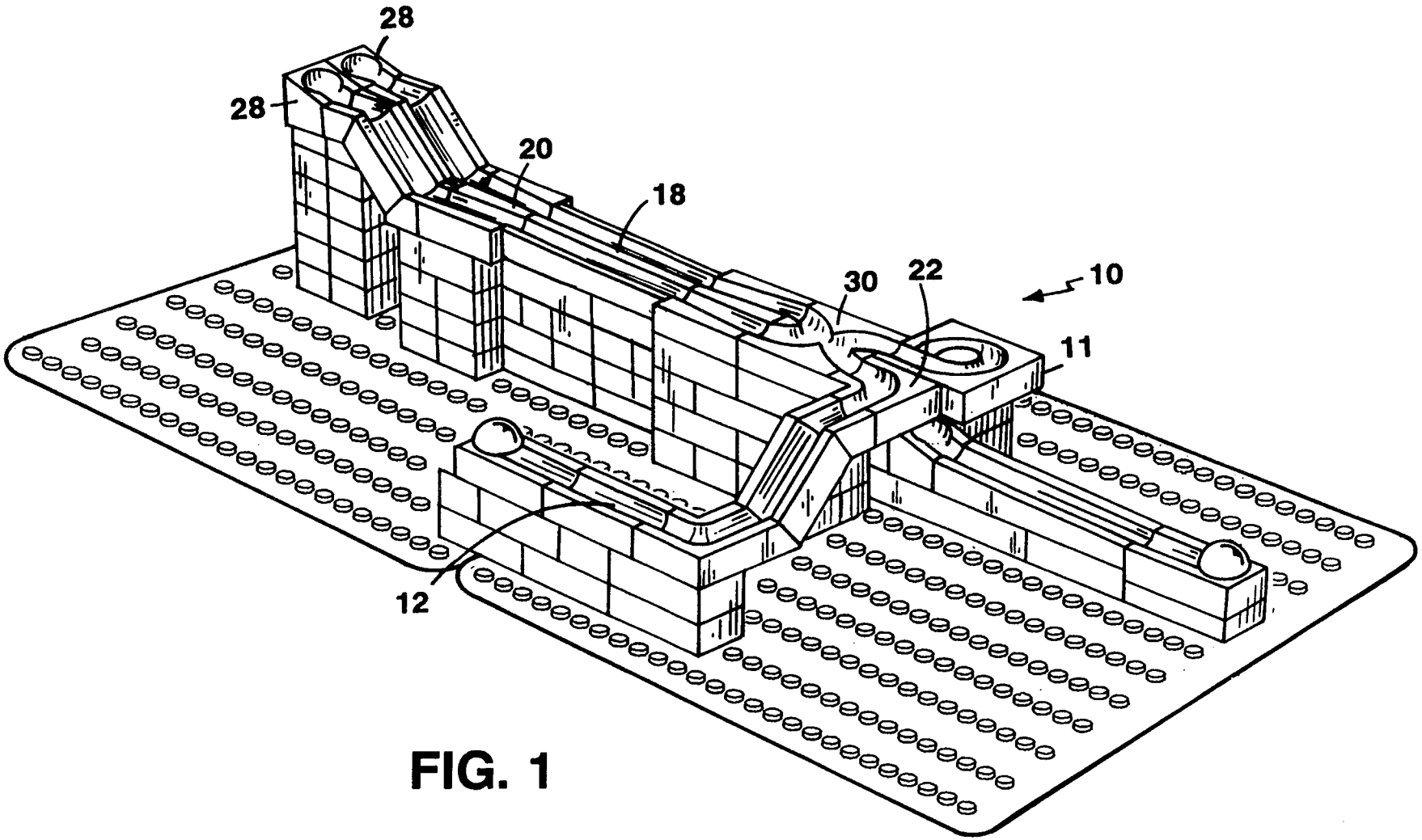
Figure 1A:
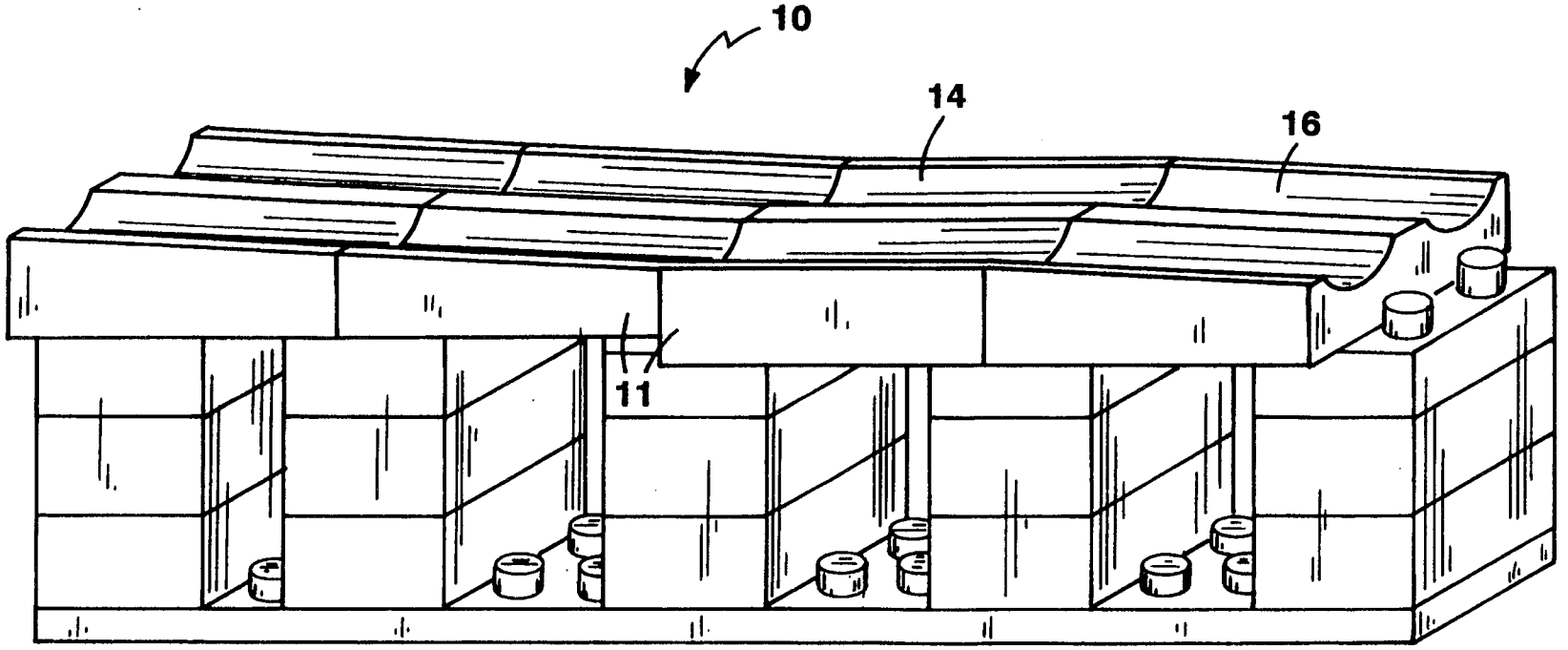
FIG. 1A is a similar view of another arrangement of elements of a marble run game of the invention.
Figure 2:
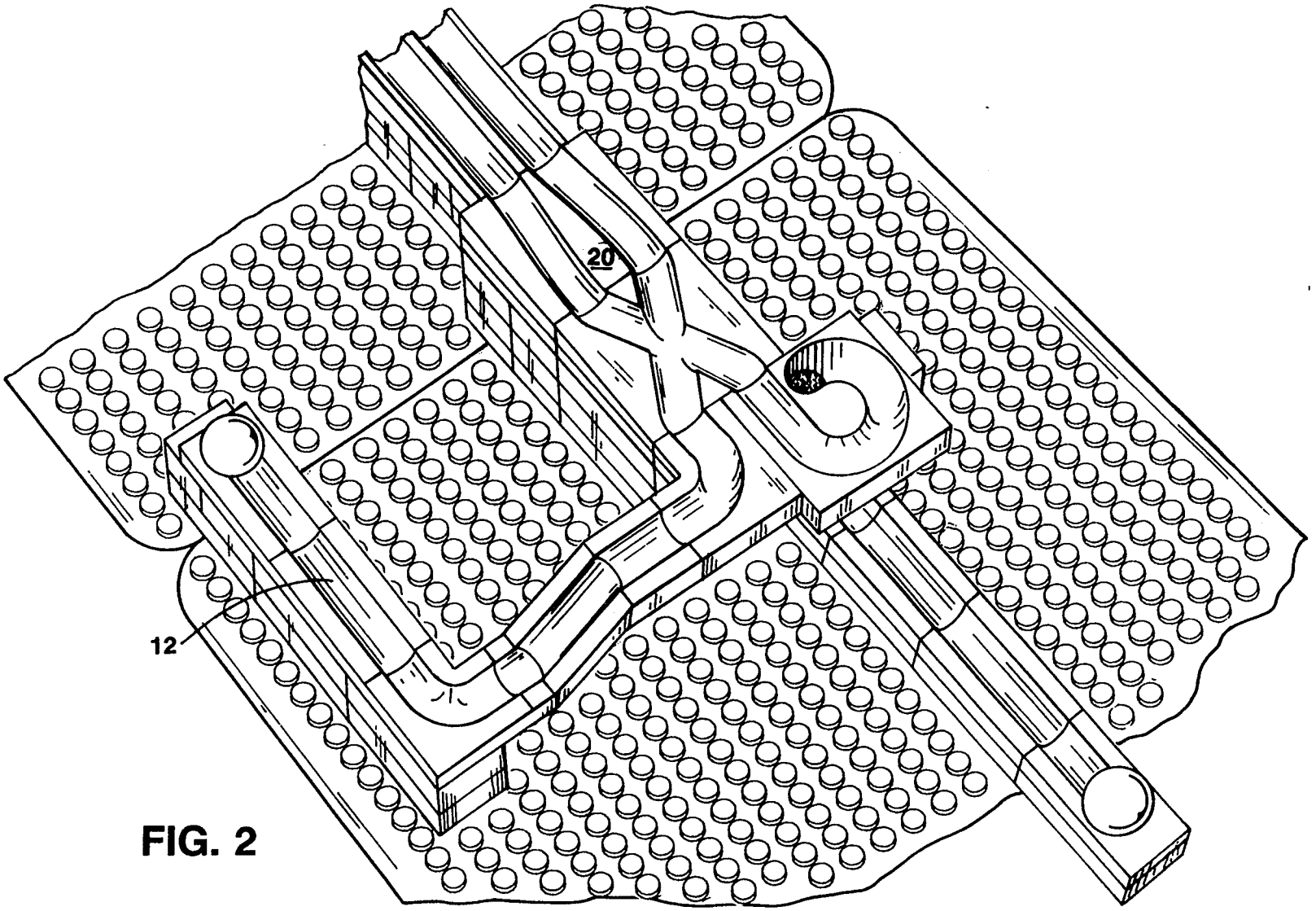
FIG. 2 is a partial top perspective view of the embodiment of FIG. 1.

Referring to FIGS. 1, 1A and 2, a marble run game 10 of the invention consists of a set of a multiplicity of block elements 11 constructed to be assembled together (and disassembled) by the user upon a base support in any desired arrangement having suitable generally horizontal slope, thereby to provide an elongated horizontal run for travel of a marble or other sphere. The marble run game 10 of the invention may be used, e.g., with peg blocks of the type sold by Lego Futura ApS (Billund, Denmark) under the trademark LEGO ®, as shown by way of example only in FIGS. 1 and 2, or with peg or other blocks of different type or source, or with any base support structure.

Figure 3:
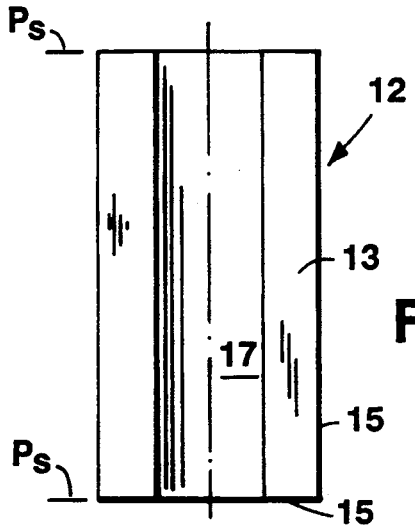
FIGS. 3, 3A and 3B are respective top, end and side plan views of one embodiment of a single run block element of a marble run game of the invention.
Figure 3A:
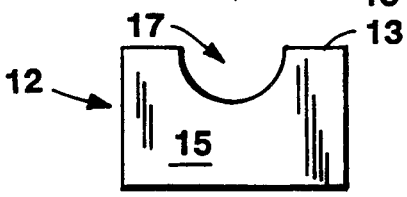
Figure 3B:
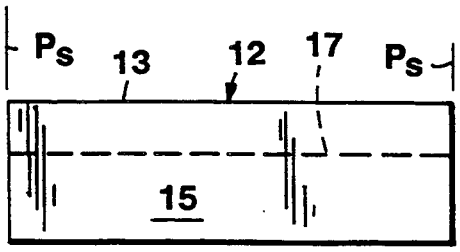
Figure 4:
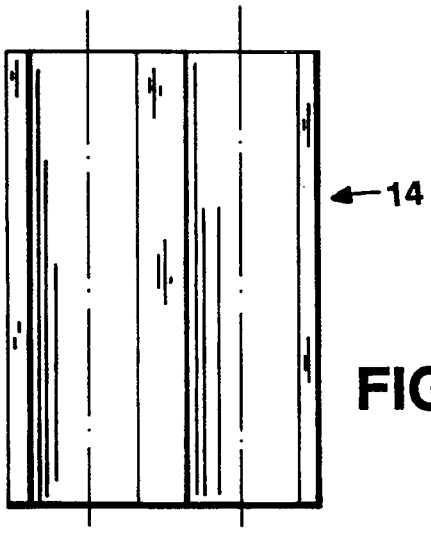
FIGS. 4, 4A and 4B are respective top, end and side plan views of one embodiment of a double run block element of a marble run game of the invention.
Figure 4A:
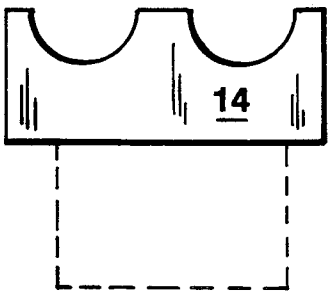
Figure 4B:
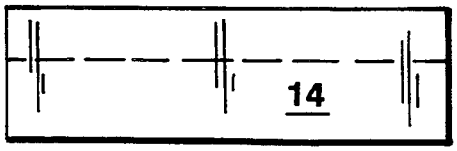
Figure 5:
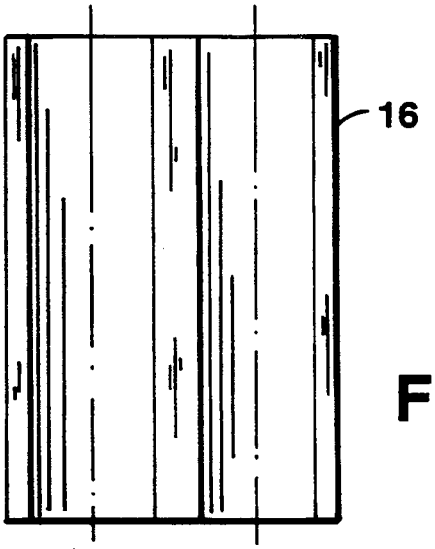
FIGS. 5, 5A and 5B are respective top, end and side plan views of one embodiment of a double sloped run block element of a marble run game of the invention.
Figure 5A:
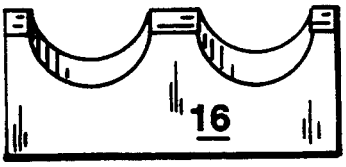
Figure 5B:
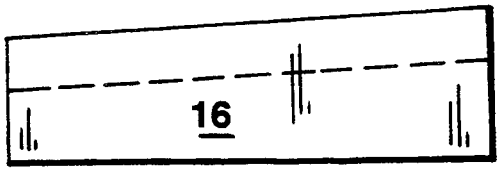
Figure 6:
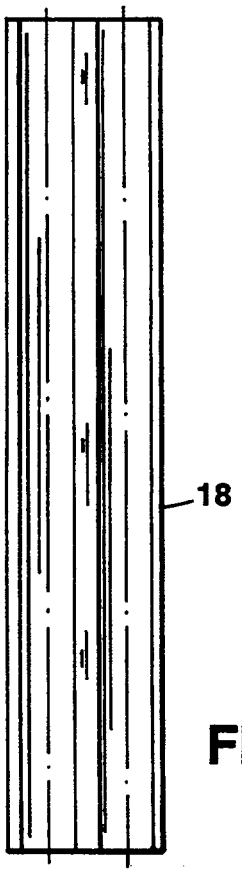
FIGS. 6, 6A and 6B are respective top, end and side plan views of another embodiment of a double sloped run block element of a marble run game of the invention.
Figure 6A:
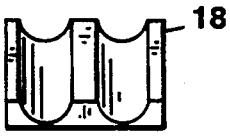
Figure 6B:
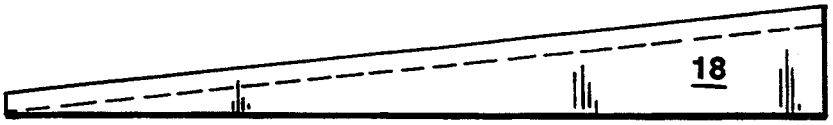
Figure 7:
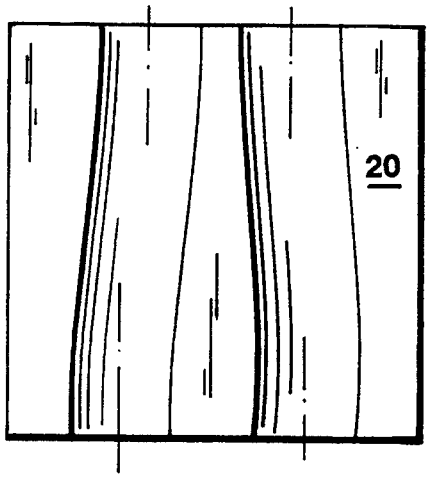
FIGS. 7, 7A and 7B are respective top, end and side plan views of one embodiment of a double run/single run splitter block element of a marble run game of the invention.
Figure 7A:
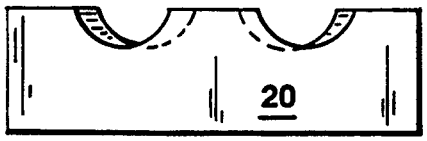
Figure 7B:
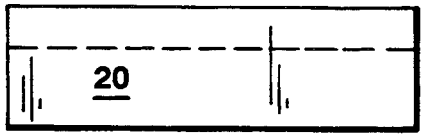
Figure 8:
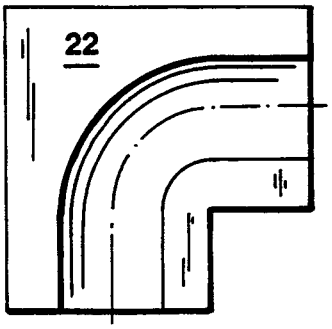
FIGS. 8, 8A and 8B are respective top, end and side plan views of one embodiment of a single run 90° corner block element of a marble run game of the invention.
Figure 8A:
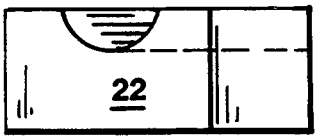
Figure 8B:
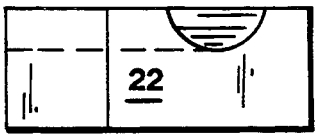
Figure 9:
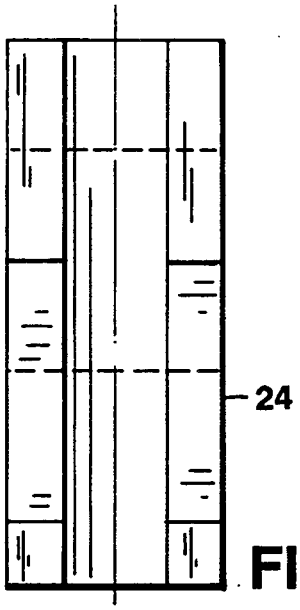
FIGS. 9, 9A and 9B are respective top, end and side plan views of one embodiment of a single run drop block element of a marble run game of the invention.
Figure 9A:
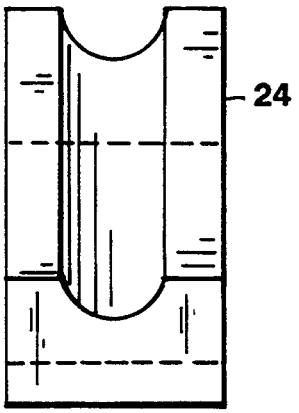
Figure 9B:
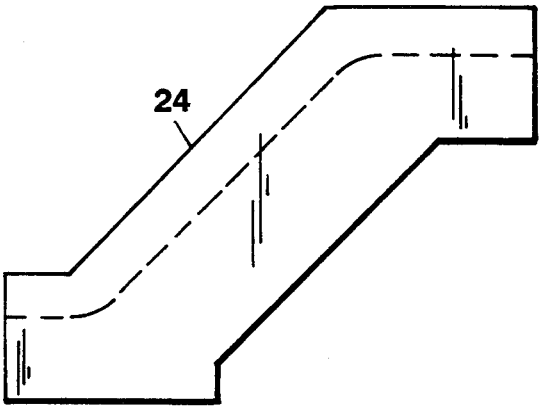
Figure 10:
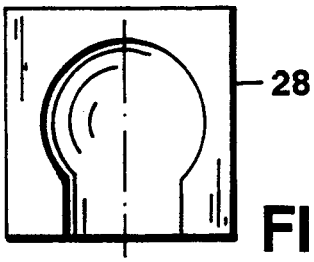
FIGS. 10, 10A and 10B are respective top, end and side plan views of one embodiment of a single run start-/end block element of a marble run game of the invention.
Figure 10A:
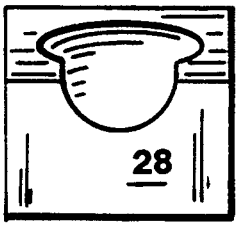
Figure 10B:
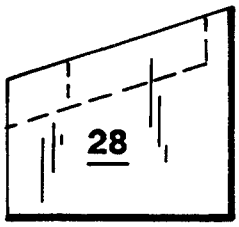
Figure 12:
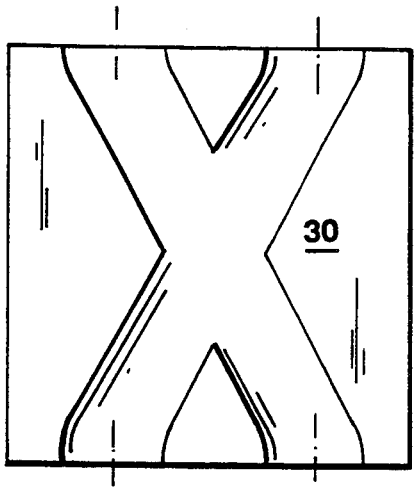
FIGS. 12, 12A and 12B are respective top, end and side plan views of one embodiment of a double run cross-over block element of a marble run game of the invention.
Figure 12A:
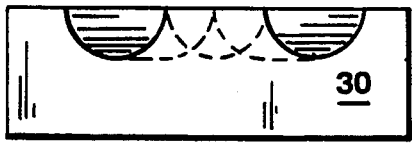
Figure 12B:
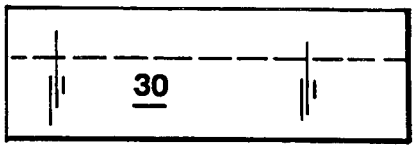
Figure 13:
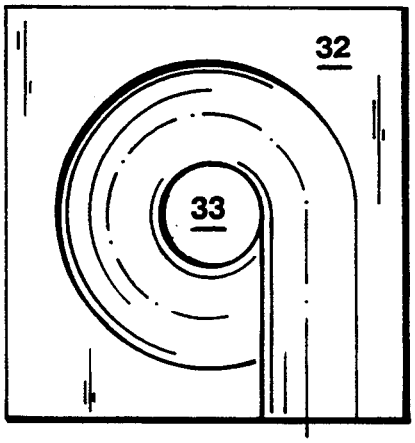
FIGS. 13, 13A and 13B are respective top, end and side plan views of one embodiment of a single run circular drop through block element of a marble run game of the invention.
Figure 13A:
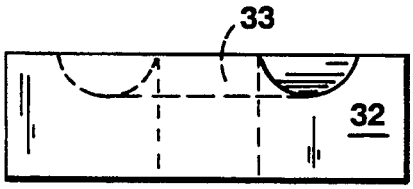
Figure 13B:
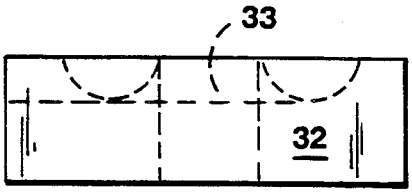

As shown in these figures, a typical marble run of the invention might include the following: several block elements with a flat upper surface and defining a single run (block elements 12, FIGS. 3–3B) or a double run (block elements 14, FIGS. 4–4B); a block element 16 having a relatively small horizontal slope, e.g., for maintaining the momentum of a marble (FIGS. 5–5B), or a somewhat greater slope for imparting momentum (block element 18, FIGS. 6–6B); a block element 20 for combining single runs into a double run (FIGS. 7–7B) or, in reverse, splitting a double run (not shown); block elements 22 for turning the marble run in a 90° corner (FIGS. 8–8B); a one or more block elements defining a steep drop for imparting momentum to the marble in a single run (block element 24, FIGS. 9–9B) or a double run (not shown); a block element 28 defining a starting point or an ending point (FIGS. 10–10B); a block element 30 defining a double run cross-over (FIGS. 12–12B); and block elements 32 each defining a single run circular drop through 33 (FIGS. 13–13B).

Referring again to FIGS. 3–3B, a typical block element has a top surface 13 and one or more side (or end) surfaces 15, the top surface and a side (or end) surface of the block element together defining at least one groove 17 for travel of a marble along the top surface and through a plane, $P_s$, of the side surface.

Figure 14:
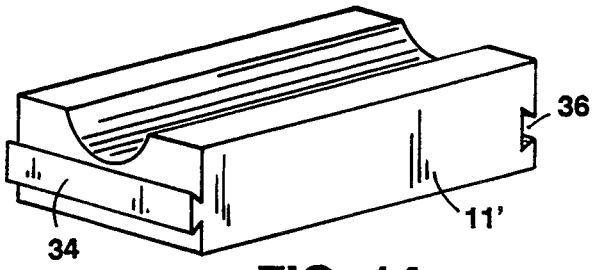
FIGS. 14 and 14A are perspective and side views respectively.
Figure 14B:
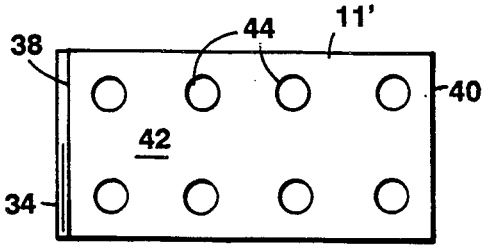
FIG. 14B is a bottom view, of another embodiment of a block element of a marble run game of the invention, with cooperating horizontal dove-tail and groove securement structure.
Figure 14A:
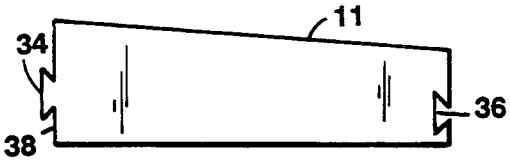

Referring now to FIGS. 14 and 14A, in one preferred embodiment, block elements 11' of a marble run game 10 of the invention are secured together by means of cooperating horizontal dove-tail tongue 34 and groove 36 securement structure. According to this embodiment of the invention, block elements are provided with respective tongue and groove structures on the opposite (or other appropriate) side surfaces, e.g. in a block defining a single, straight run as shown in the drawings, the tongue 34 is defined by a first end surface 38 and a groove 36 is defined in an opposite end surface 40. Adjacent blocks in a run may then be secured together by inter-engagement of the tongue and grooves defined by the opposed end surfaces of the block elements.

Referring also to FIG. 14B, in the preferred embodiment, where the block elements are particularly constructed for use with peg blocks, e.g. of the type sold by Lego Futura ApS (Billund, Denmark) under the trademark LEGO ®, or of the type sold under the trademark DUPLO ®, or with peg blocks of different type or source, the bottom or undersurface 42 of the block element 11 defines a plurality of apertures 44 sized and positioned to fit in registration with the underlying pegs of a peg block construction.

Figure 16:
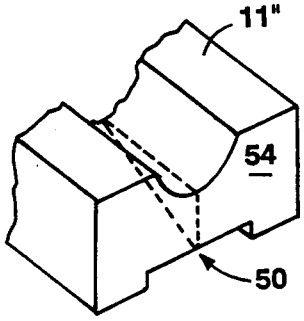
Figure 18:
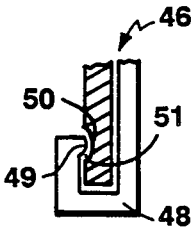
FIG. 18 is a side section view of the joined end portions of a pair of block element secured together by inter-engagement of the structure of FIGS. 16 and 17.
Figure 17:
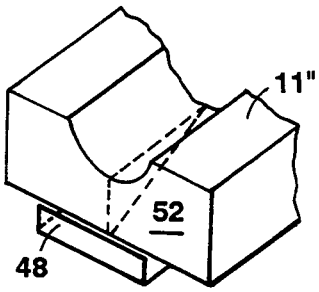

Referring now to FIGS. 16, 17 and 18, in another embodiment, block elements 11'' of a marble run game 10 of the invention are secured together by means of cooperating securement structure 46 consisting of a snap hook 48, with a lip 49, and cooperating slot 50, and groove 51, provided on the opposite (or other appropriate) side surfaces of the block element. As shown in FIG. 18, the snap hook 48 is attached at a first end surface 52 and a slot 50 is defined at an opposite end surface 54. Adjacent blocks in a run may then be secured together by engagement of the snap hook in the slot at opposed end surfaces of the block elements.

Figure 19:
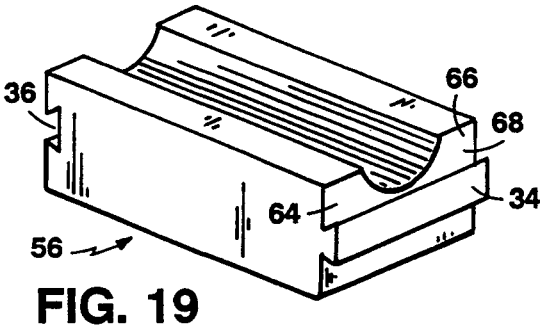
FIGS. 19 and 20 are perspective view of other embodiments of block element of the invention.
Figure 20:
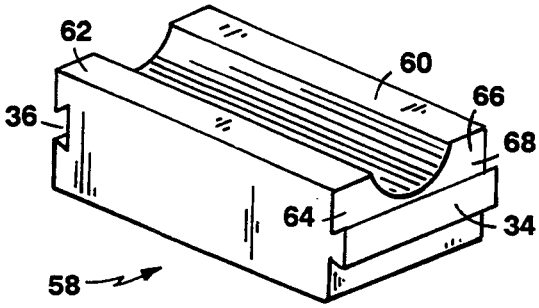

Referring now to FIGS. 19 and 20, for operation of powered accessory elements, power block elements 56, 58 may, e.g., contain a battery in a compartment defined in the base of the block (FIG. 19) or the face surface 60 may define one or more solar panels 62 (FIG. 20). The power generated at the power block elements may be distributed through one or more adjacent block elements by means of electrical contacts 64, 66 provided in the end face surface 68, and brought into electricity-conducting contact by engagement of the securement structure, e.g. horizontal tongue and groove structures 34, 36.

Figure 21:
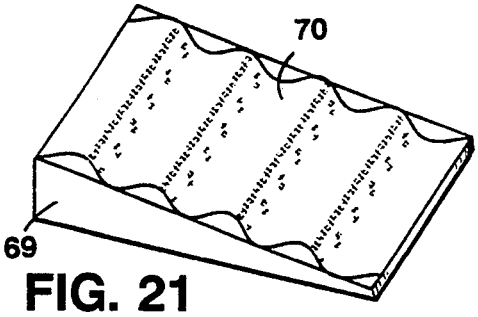
FIGS. 21 et seq. are somewhat diagrammatic views of various accessory elements for use in a marble run game of the invention, as follows.

A marble run game 10 of the invention may be used also with any of a variety of accessory items for increased entertainment and enjoyment. Referring next to FIGS. 21 et seq., a selection of these accessory items are shown.

FIG. 21 shows an ramp element 69 having a washer board surface 70 that may emit a sound as a marble descends.

Figure 22:
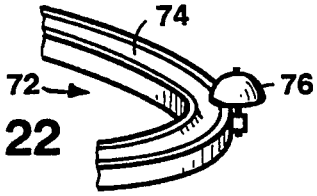
FIG. 22 shows a curved run with a bell.

FIG. 22 shows an element 72 curved run 74 with a bell 76 positioned to be struck by a marble as it passes.

Figure 23:
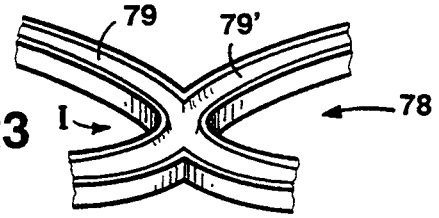
FIGS. 23–25 show intersecting dual curved runs.
Figure 24:
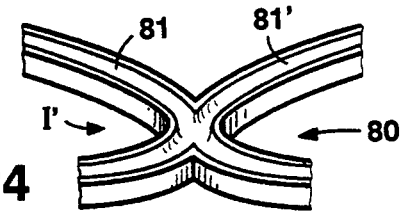
Figure 25:
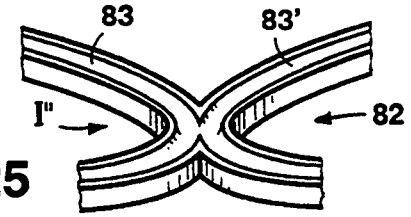
Figure 26:
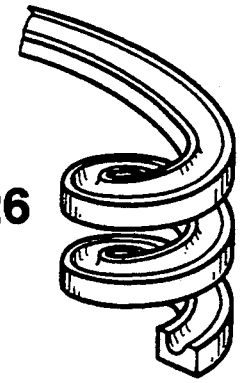
FIGS. 26–31 show curved and spiral runs.
Figure 29:
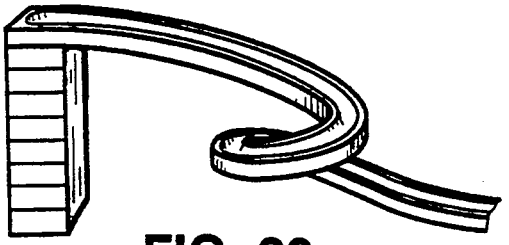
Figure 27:
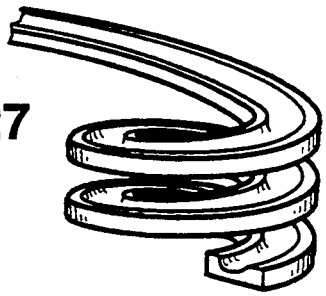

FIGS. 23–25 show elements 78, 80, 82, respectively, having intersecting dual curved runs of mirror image. In FIG. 23, the runs 79, 79′ are spaced apart at the intersection, I, so the marbles on each run pass without interference. In FIG. 24, the runs 81, 81′ are spaced closer together at the intersection, I′, in a manner to permit only one marble to pass the intersection at a time. In FIG. 25, the runs 83, 83′ are spaced is a manner to cause the marble to cross over to the opposite run at the intersection, I″.

Figure 30:
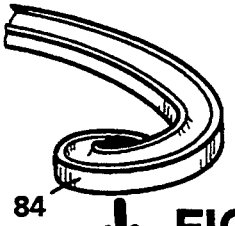
Figure 28:
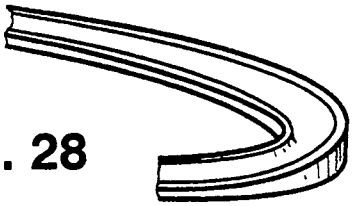
Figure 31:
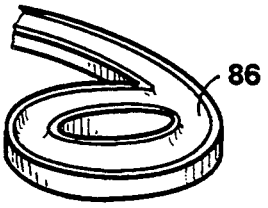
Figure 32:
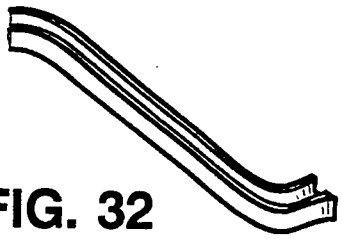
FIGS. 32–35 show sloped run accessories, each with a ramp at the lower end.

FIGS. 26–31 show elements having various curved and spiral runs of various slope and radius, with FIG. 30 show a drop hole termination 84 and FIG. 31 showing a closed loop termination 86.

Figure 34:
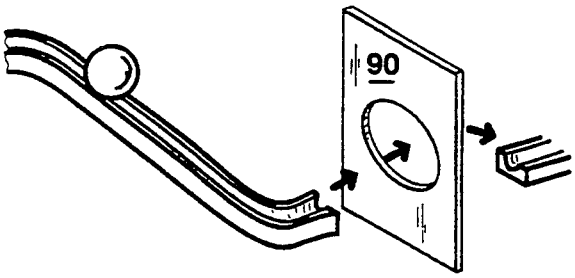
Figure 35:
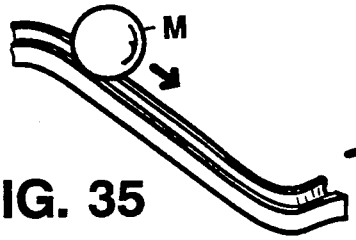
Figure 33:
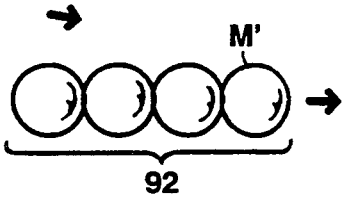
Figure 33:
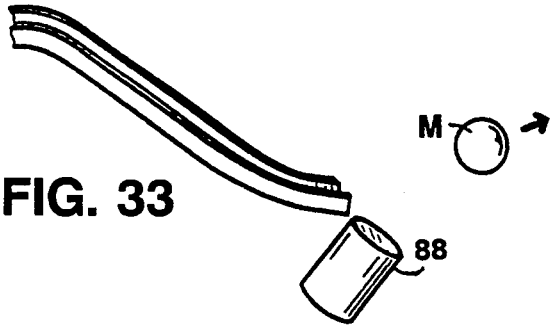

FIGS. 32–35 show elements having various sloped runs, each with a ramp at the lower end. In FIG. 33, a marble, M, is delivered into a spring loaded cannon 88. In FIG. 34, a marble, M, is delivered through a hoop 90 toward a continuation of the ramp. In FIG. 35, a marble, M, is caused to strike upon row 92 of marbles to impart momentum to the furthermost marble, M′.

Figure 36:
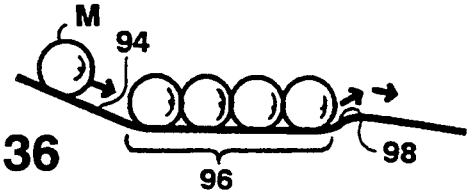
FIG. 36 shows a sloped run with a set of marbles at the base.

In FIG. 36, a marble, M, descends a sloped run 94 to caused to strike against a set of marbles 96, thus to impart sufficient momentum to lift the last marble, M′, over an impeding lip 98.

Figure 38:
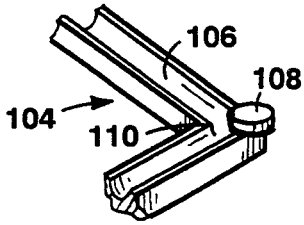
FIG. 38 shows a sloped run with a bumper at the corner.
Figure 37:
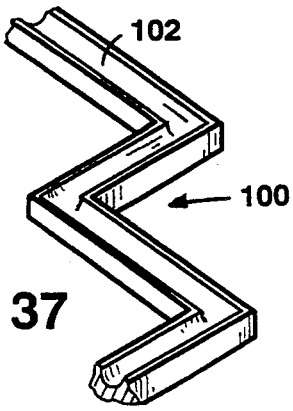
FIG. 37 shows a sloped zigzag run.
Figure 39:
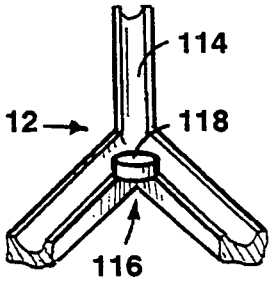
FIG. 39 shows a sloped run with a y-intersection and a bumper.

FIG. 37 shows an element 100 defining a sloped zip-zag run 102. FIG. 38 shows an element 104 having a similar sloped run 106 with a bumper 108 at the corner 110 to facilitate passage of a marble. FIG. 39 shows an element 112 defining a sloped run 114 with a y-intersection 116 and a bumper 118, also to facilitate passage of a marble.

Figure 40:
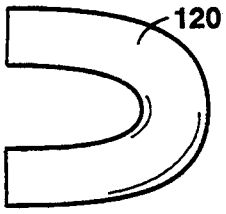
FIGS. 40 and 41 show u-turn tunnels.
Figure 41:
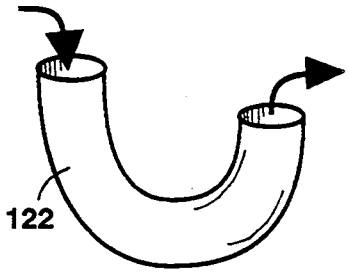
Figure 42:
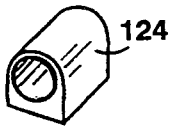
FIGS. 42 and 43 show straight tunnels.
Figure 43:
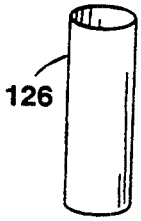

FIG. 40 shows a horizontal u-turn tunnel 120. FIG. 41 shows a vertical u-turn tunnel 122, perhaps containing one or more marbles a set of marbles with entry of each marble driving the last marble from the tunnel (indicated by arrows). FIGS. 42 and 43 are straight horizontal and vertical tunnels 124, 126, respectively.

Figure 44:
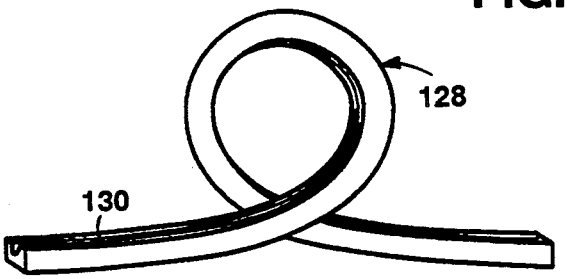
FIGS. 44 and 45 show loop runs.
Figure 45:
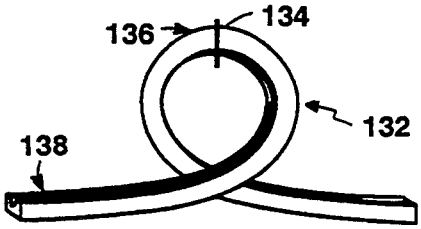

FIG. 44 shows an element 128 defining a loop run 130. FIG. 45 shows a similar element 132, with a stop 134 at the apex 136 of the loop run 138 which causes a marble to drop back onto the lower portion of the run, thus reversing direction.

Figure 46:
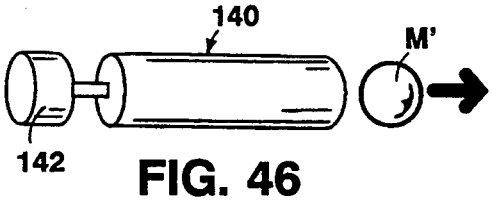
FIGS. 46, 47 and 48 show spring-loaded impellers.
Figure 47:
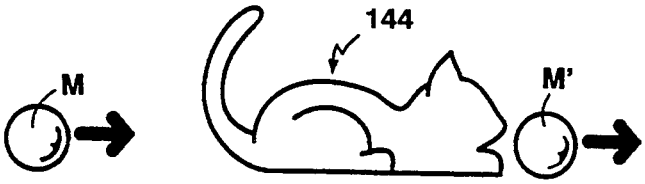
Figure 48:
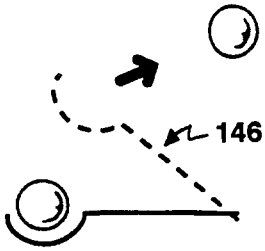

FIG. 46 is a spring-loaded impeller 140 actuated to strike marble, M′, by drawing back on the handle 142. FIG. 47 is also a spring-loaded impeller 144 that may be released (to strike marble, M′) by action of a marble, M, striking from the rear. FIG. 48 shows a spring loaded catapult 146.

Figure 49:
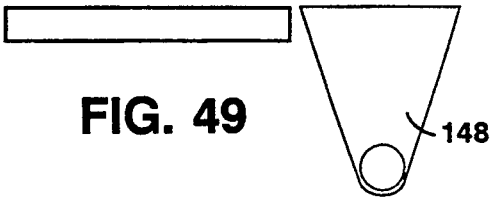
FIGS. 49, 50 and 51 show tilt cup devices.
Figure 50:
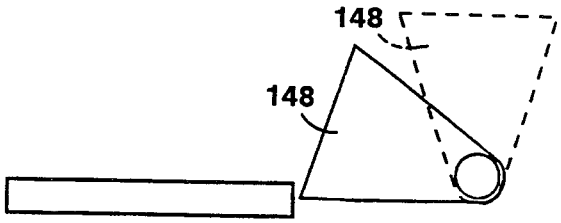
Figure 51:
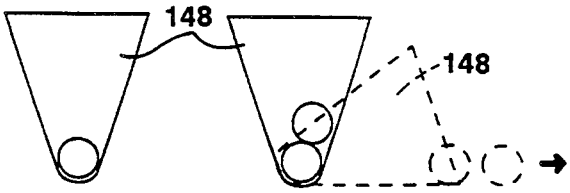

FIGS. 49–51 show various arrangements of tilt cups 148 positioned to receive a marble (FIG. 49) or deliver a marble (FIG. 50). The tilt cup 148 may be mounted for actuation only upon receiving two or more marbles (FIG. 51).

Figure 52:
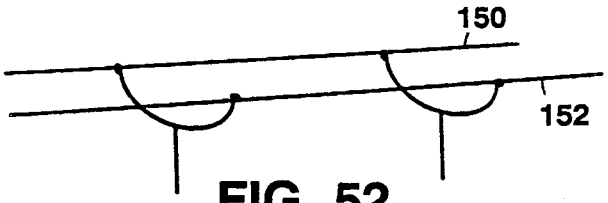
Figure 53:
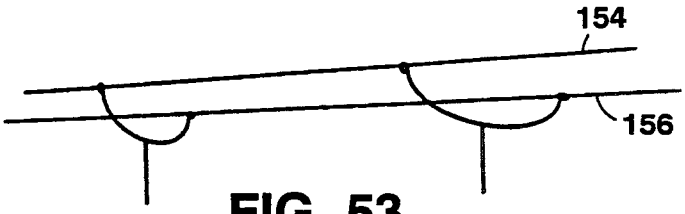
Figure 54:
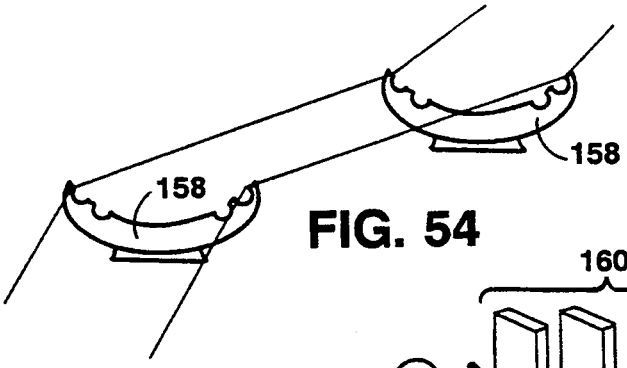
FIG. 54 shows wire spacers.

FIGS. 52–54 show wire elements. In FIG. 52, the wires 150, 152 are uniformly spaced apart at a predetermined distance to permit a marble to travel therealong. In FIG. 53, the wires 154, 156 are splayed to cause the marble to drop after traveling therealong. FIG. 54 shows parallel wire spacers 158 of another embodiment.

Figure 55:
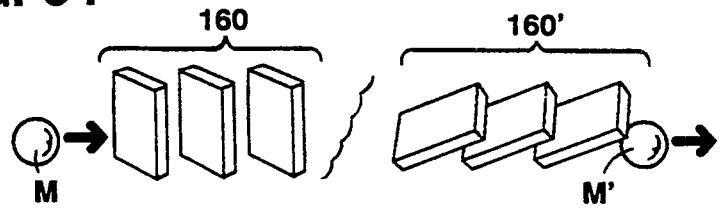
FIG. 55 shows an arrangement of dominos or the like struck by a marble.

FIG. 55 shows an element with arrangement of dominos 160 or the like positioned to be struck and knocked down by a marble, M, and the falling dominos 160′ initiating movement by a second marble, M′.

Figure 56:
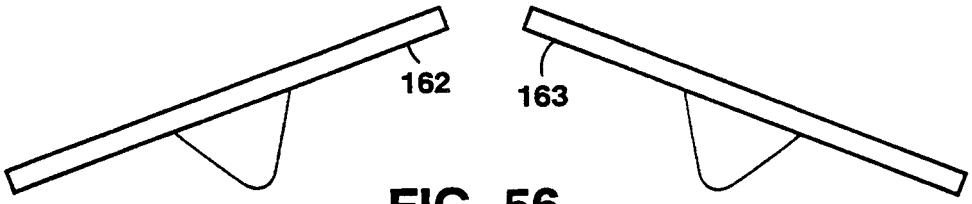
FIG. 56 shows a device consisting of an arrangement of see-saws.

FIG. 56 shows an arrangement of see-saws 162, 163 positioned to received and deliver a marble thereacross.

Figure 57:
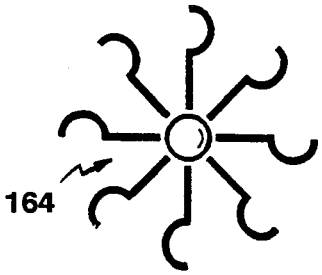
FIG. 57 shows a powered device in the form of a ferris wheel.
Figure 58:
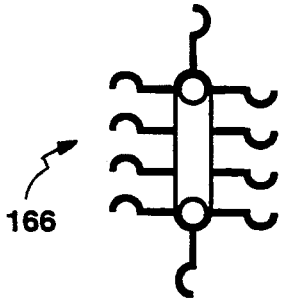
FIG. 58 shows a powered device in the form of a conveyor lift.
Figure 59:
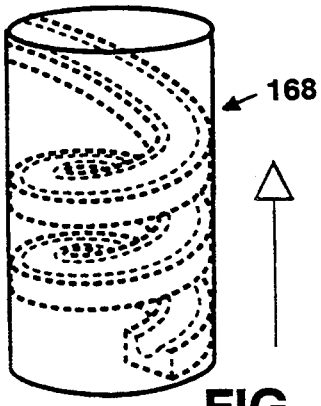
FIG. 59 shows a powered device in the form of a spiral elevator.

FIGS. 57–59 show accessory devices that may be powered by hand, battery or electricity. FIG. 57 shows an element 164 having the form of a ferris wheel, FIG. 58 shows an element 166 having the form of a conveyor lift and FIG. 59 shows an element having the form of a spiral elevator.

Figure 60:
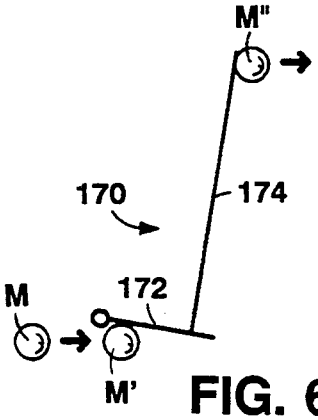
FIG. 60 shows an arrangement by which a first marble on a lower run is delivered against an actuator that is positioned to initiate motion by a marble on an upper run.

FIG. 60 shows an element 170 arranged so that a first marble, M, on a lower run is delivered against a marble, M′, position beneath a first actuator arm 172, which in turn act upon an second actuator 174 positioned to initiate motion by a marble, M′, on an upper run.

Figure 61:
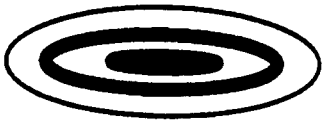
FIGS. 61 and 62 show simple target accessories.
Figure 62:
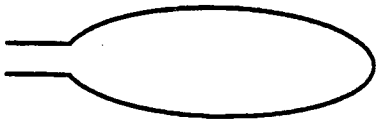
Figure 63:
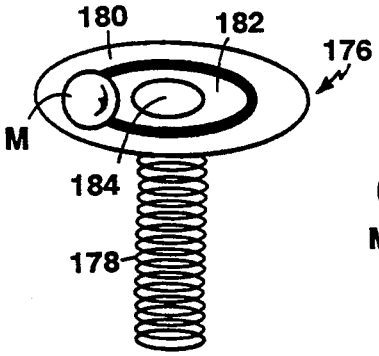
FIGS. 63, 63A, 63B, 64 and 65 show target accessories of a more complex nature.
Figure 63A:
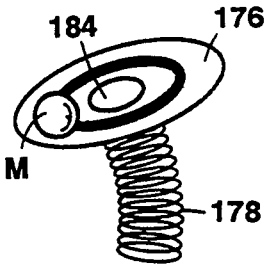
Figure 63B:
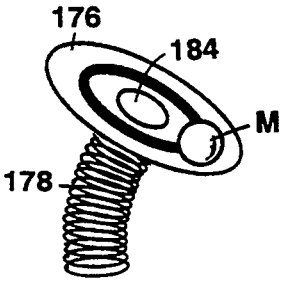
Figure 64:
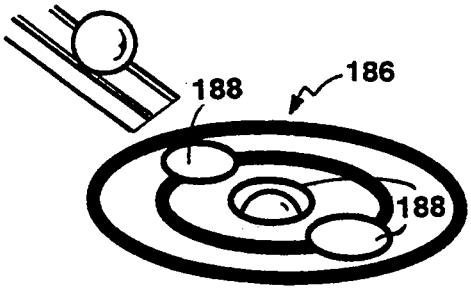
Figure 65:
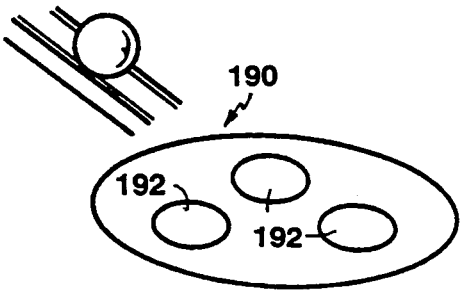

FIGS. 61 and 62 show simple target accessories, while FIGS. 63–64 show targets that are somewhat more complex. In FIGS. 63, 63A and 63B, a target 176 is mounted on a vertical spring 178. The target has a rim 180 surrounding a depressed target area 182, with an aperture 184 at the center. The weight of a marble, M, striking the target 176 causes deflection of the target (FIGS. 63A, 63B), thus delaying the marble from passing into the aperture 184 and downward through a vertical passage defined by the spring 178. In FIG. 64, a target 186 has holes 188 with different point values for scoring accuracy. In FIG. 65, a target 190 has holes 192 for delivering a marble to different runs, depending upon the hole that is accessed.

Figure 66:
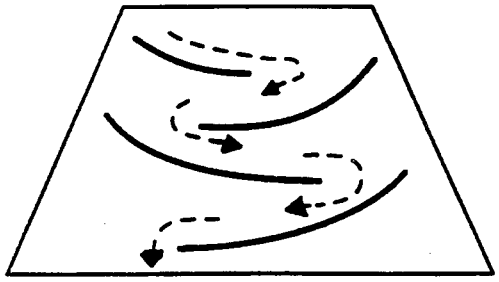
FIG. 66 shows a maze.

FIG. 66 shows a maze element that may be assembled by a user.

Figure 67:
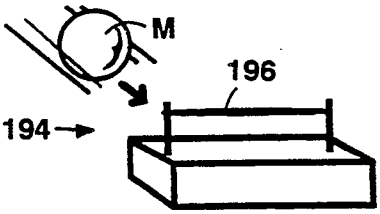
FIG. 67 shows an elastic target.

FIG. 67 shows an element 194 having an elastic target 196 against which a marble, M, may be delivered.

Figure 68:
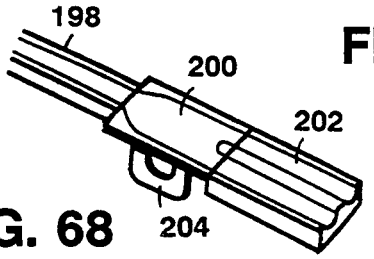
FIGS. 68 and 69 show magnetic accessory devices for use with steel or iron marbles.
Figure 69:
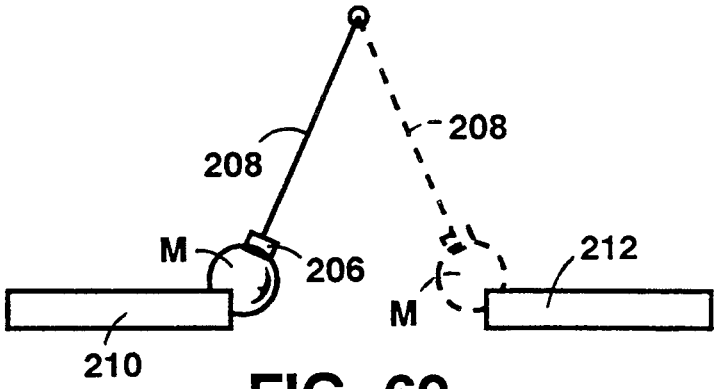

FIGS. 68 and 69 show magnetic accessory devices for use with steel or iron marbles. In FIG. 68, a marble exiting a single run 198 crosses an open area 200 leading to a double run 202. One or more magnets 204 are disposed beneath the open area, thereby to affect the passage of the marble. In FIG. 69, a magnet 206 on a swinging arm 208 attaches magnetically upon a marble, M, moving along a first run 210 and swings the marble across an open region to a second run 212.

Figure 70:
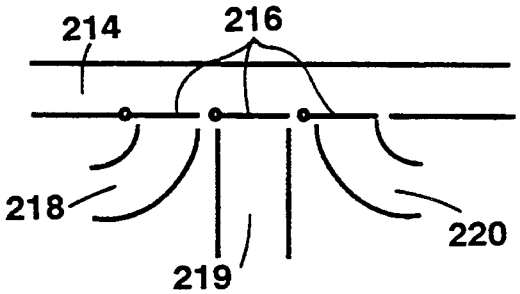
FIGS. 70 and 71 show a run with several gates.
Figure 71:
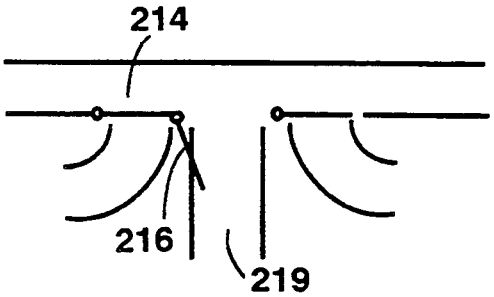

FIGS. 70 and 71 show a run 214 with several gates 216 that may be triggered by passage of a marble, each gate leading to a different path 218, 219, 220.

Figure 72:
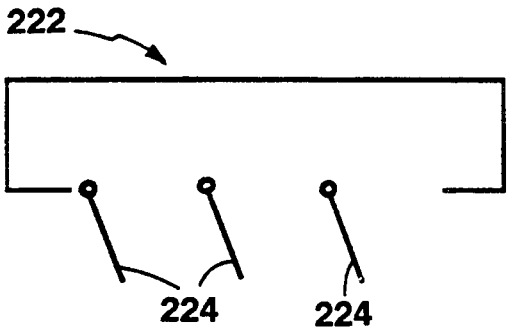
FIG. 72 shows a starting element with several gates.

FIG. 72 shows a starting element 222 with several gates 224 that may be opened simultaneously.

Figure 73:
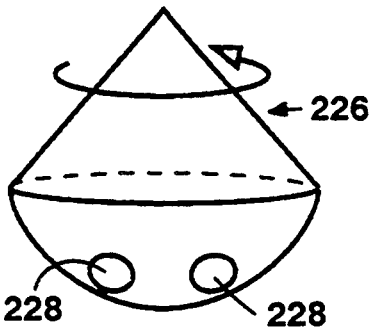
FIG. 73 shows a rotatable starting element.

FIG. 73 shows a starting element 226 that is rotated (arrow R) to deliver a marble through one of several openings 228.

Figure 11:
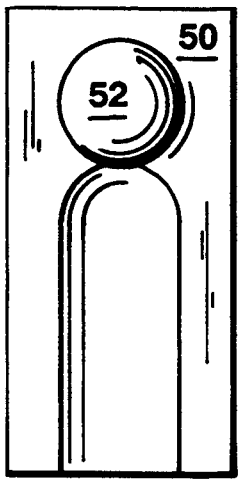
FIGS. 11, 11A and 11B are respective top, end and side plan views of another embodiment of a single run end block element with a bell.
Figure 11A:
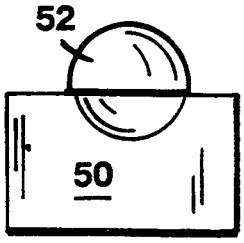
Figure 11B:
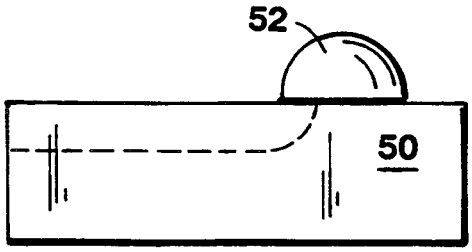
Figure 15:
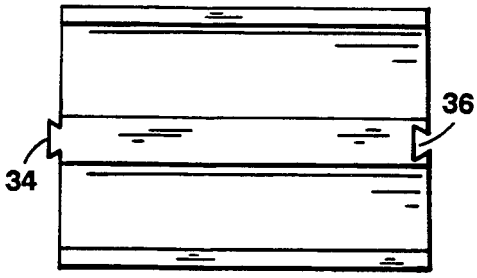
FIG. 15 is a top plan view of another embodiment of a block element of a marble run game of the invention, with cooperating vertical dove-tail and groove structure.

Other embodiments are within the following claims. For example, a block element 20 (FIGS. 7-7B) may be employed in reverse for splitting a double run. Block elements 22 may be provided for turning the marble run at other angles, whether predetermined or selected by the user. Referring to FIGS. 11-11B, an end block element 50 may be equipped with a bell 52 positioned to be struck by a marble completing its run. Referring to FIG. 15, a set of block elements 54 may be provided with vertical tongue 56 and groove 58 securement structure.

What is claimed is:

1. A marble run game comprising a set of block elements constructed and arranged for assembly and disassembly by a user to create an extended, generally horizontal path for travel of a marble, each said block element having a top surface and one or more side surfaces, said top surface and at least one said side surface of said block element together defining at least one groove for generally horizontal travel of a marble along said top surface and through a plane of said side surface, and each said block element further comprising means for securement with an adjacent block element, said means for securement comprising a first securement element defined by a side surface of a first block element and a cooperating second securement element defined by an adjacent side surface of an adjacent second block element, said first and second securement elements adapted to interengage in a manner to secure alignment of grooves defined by the first and second block elements and to resist separation of the first and second block elements under axially-applied horizontal forces.

2. The marble run game of claim 1 wherein said means for securement comprises a tongue extending from the side surface of the first block element and a cooperating groove defined by the adjacent side surface of the adjacent second block element.

3. The marble run game of claim 1 wherein said means for securement comprises a hook member extending from the side surface of the first block element and a cooperating slot defined by the adjacent side surface of the adjacent second block element.

4. The marble run game of claim 3 wherein said hook member comprises a lip, and said slot defined by the adjacent side surface of the adjacent second block element comprises a cooperating groove.

5. The marble run game of claim 1 wherein each said block element has a base surface opposite said top surface, and said base surface defines a plurality of apertures sized and arranged for registration with pegs of a peg block construction toy.

6. The marble run game of claim 1 wherein said top surface and a said side surface of said block element together define a first groove for travel of a marble along said top surface and through a plane of said side surface; and said top surface and a said side surface of said block element together define a second groove for travel of a marble along said top surface and through a plane of said side surface.

7. The marble run game of claim 6 wherein said first groove and said second groove intersect upon said top surface.

8. A marble run game comprising a set of block elements constructed and arranged for assembly and disassembly by a user to create an extended, generally horizontal path for travel of a marble, each said block element having top surface and one or more side surfaces, said top surface and at least one said side surface of said block element together defining at least one groove for generally horizontal travel of a marble along said top surface and through a plane of said side surface, said set of block elements comprising at least a first block element that, in use, has a top surface that defines a groove that is substantially horizontal and at least a second block element that, in use, has a top surface that defines a groove that is substantially sloped from the horizontal, said first block element and said second block element together defining said path for travel of a marble.

9. A marble run game comprising a set of block elements constructed and arranged for assembly and disassembly by a user to create an extended, generally horizontal path for travel of a marble, each said block element having top surface and one or more side surfaces, said top surface and at least one said side surface of said block element together defining at least one groove for generally horizontal travel of a marble along said top surface and through a plane of said side surface, at least one block element of said set of block elements defining an opening in connection with said groove and extending from said top surface, said opening sized for passage of a marble along said groove and through said opening.

10. A marble run game comprising a set of block elements constructed and arranged for assembly and disassembly by a user to create an extended, generally horizontal path for travel of a marble, each said block element having a top surface and one or more side surfaces, said top surface and at least one said side surface of said block element together defining at least one groove for generally horizontal travel of a marble along said top surface and through a plane of said side surface, said set of block elements including a power block element comprising a source of electrical power, and means for conducting electrical power to adjacent block elements.

11. The marble run game of claim 10 wherein said source of electrical power comprises a solar panel disposed upon a surface of said power block element.

* * * * *